United States Patent [19]

Nishimura et al.

[11] 4,368,778

[45] Jan. 18, 1983

[54] HEAT EXCHANGER WITH U-TUBES

[75] Inventors: Yoshinori Nishimura; Takayuki Kaneko, both of Chiba; Jun Zamma, Yachiyo; Youichi Nakajima, Chiba, all of Japan

[73] Assignee: Toyo Engineering Corporation, Japan

[21] Appl. No.: 196,627

[22] Filed: Oct. 14, 1980

[30] Foreign Application Priority Data

Jan. 30, 1980 [JP] Japan ..... 55-8743

[51] Int. Cl.[3] ..... F28D 7/06

[52] U.S. Cl. ..... 165/158; 165/163

[58] Field of Search ..... 165/163, 158, 176

[56] References Cited

U.S. PATENT DOCUMENTS 130,088 7/1872 Walker ..... 165/176
2,502,675 4/1950 Simpelaar ..... 165/163
3,083,833 4/1963 Kasten ..... 165/142
3,231,013 1/1966 Heller et al. ..... 165/176

FOREIGN PATENT DOCUMENTS 28847 of 1913 United Kingdom ..... 165/176
2014293 8/1979 United Kingdom ..... 165/163

*Primary Examiner*—Sheldon J. Richter
*Attorney, Agent, or Firm*—McGlew and Tuttle

[57] ABSTRACT

Tubes are positioned in a shell of a heat exchanger, hot fluid flowing through the tubes. An inlet of each of the tubes for hot fluid is opened to a separate section which is provided with a clearance from a thick tube sheet secured to the shell. An inlet and outlet port of each of the tubes are positioned alternately at the tube sheet. By the provision of the separate section and alternate positioning of inlets and outlets of tubes, thermal stress arising in the thick tube sheet is made very small.

4 Claims, 14 Drawing Figures

PRIOR ART FIG. 1a'

PRIOR ART FIG. 1a''

HEAT EXCHANGER WITH U-TUBES

BACKGROUND OF THE INVENTION

The present invention relates to heat exchangers for high temperature and high pressure service, in which the temperature gradient in a thick tube sheet is decreased and thermal stress caused thereby is reduced accordingly. More particularly the present invention relates to heat exchangers, in which a hot fluid before being heat exchanged is prevented from directly contacting a thick tube sheet, said hot fluid being introduced from a separate section through a group of tubes into a heat exchanger shell and discharged through a fluid outlet nozzle opened at the tube sheet, with groups of those tubes for fluid before and after heat exchange being alternately arranged, thereby resulting in a large reduction of thermal stress in the thick tube sheet.

Generally, heat exchangers are used to recover heat from or exchange heat with a hot gas generated by burning, or by a chemical reaction or the like in chemical and various other industrial plants.

Conventionally, various types of heat exchangers are used, one of which uses a U-tube type heat exchanger. The heat exchanger of this type is superior to others in that thermal stress is prevented from occurring, which is caused by different thermal expansion being induced by the temperature difference between the tubes and the shell.

The heat exchangers of the U-tube type being conventionally used are shown in FIGS. 1 (*a*), (*a'*), (*b*) and (*b'*). FIG. 1 (*a*) is a schematic section of a an example of conventional U-tube heat exchangers, wherein U-tubes 2 are arranged in a shell 1 having inlet and outlet nozzles for a first fluid, a tube sheet being secured to the bottom end of the shell 1, the ends 2*a*, 2*b* of the U-tubes passing through and being secured to the tube sheet 3, opened to the outside of the shell. On the side of the tube sheet 3 opposite to the shell 1 there is provided a channel enclosed by a stationary head 4 and a chamber cover 5, the chamber being divided into two volumes by a pass partition 6. One of the two volumes is provided with an inlet nozzle 7 for the second fluid and the other room is provided with an outlet nozzle 8 for a second fluid, the ends 2*a* of the U-tubes 2 to admit the second fluid being completely opened to one volume and the other ends 2*b* of the U-tubes to discharge the second fluid being completely opened to the other volume. FIG. 1 (*a'*) shows the section along line A—A in FIG. 1 (*a*).

FIG. 1 (*b*) is a schematic section of another example of conventional U-tube type heat exchangers. This type comprises, similarly to the one in FIG. 1 (*a*), a shell 1 in which U-tubes 2 are contained, and a main chamber enclosed by a stationary head 4 and a main chamber cover 5. In the main chamber an inner chamber 9 having an inlet nozzle 7 for the second fluid is provided, the ends 2*a* of U-tubes to admit the second fluid being opened at the tube sheet of the inner chamber 9 and the other ends of U-tubes to discharge the second fluid being opened in the annular portion of the tube sheet between the inner chamber 9 and the stationary head 4. FIG. 1 (*b'*) shows the section along line B—B in FIG. 1 (*b*).

In the operation of the type of heat exchanger shown in FIG. 1 (*a*), a hot second fluid enters through the inlet nozzle 7 for the second fluid into the chamber and flows further through the ends 2*a* of U-tubes into the U-tubes 2, and after exchanging heat with the first fluid in the shell 1, flows, through the chamber, out from the outlet nozzle 8. Since the chamber is divided into two volumes by the pass partition 6, the chamber on the inlet side of the second fluid is filled with the hot second fluid, making the tube sheet hot.

The chamber on the outlet side of the second fluid is filled with the cold second fluid, making that portion of the tube sheet 3 colder than the inlet side. The temperature distribution in the tube sheet 3 becomes asymmetric as shown in FIG. 1 (*a''*), inducing a large thermal stress and causes the designing of the heat exchanger difficult.

In the operation of the type of heat exchanger shown in FIG. 1 (*b*), a hot second fluid enters from the inlet nozzle 7 into the inner chamber 9, flows through the inlet ports 2*a* of the U-tubes into the U-tubes 2, and after exchanging heat with the first fluid in the shell 1 and being cooled, flows out from the outlet ports 2*b* of the U-tubes into the annular space surrounding the inner chamber 9, and then leaves the heat exchanger through the outlet nozzle 8. In this case, the inside of the inner chamber 9 is filled with the hot second fluid, so the tube sheet 3 contacting the hot fluid becomes hot, but on the other hand, the tube sheet portion outside the inner chamber 9 contacts the cold second fluid after heat exchange and is made cold and therefore, the temperature distribution in the tube sheet is made as shown in FIG. 1 (*b''*), the central portion being high and the peripheral portions being low. This difference in the temperature induces thermal stress in the tube sheet 3. The stress in this case is a little smaller than the case in FIG. 1 (*a*), but still it is difficult to determine the arrangement of U-tubes for the case in FIG. 1 (*b*).

BRIEF SUMMARY OF THE INVENTION

The object of the present invention is to provide novel heat exchangers by eliminating the aforementioned problems associated with the U-tube type heat exchanger, and more particularly by minimizing the thermal stress arising in the tube sheet.

Another object of the invention is to make the design of economical and reliable heat exchangers easy by minimizing the thermal stress arising in the tube sheet of heat exchangers.

Still another object of the invention is to provide low cost heat exchangers free of using heat resistant materials for tube sheets and for avoiding contact of a hot fluid with the tube sheet as well as minimizing the thermal stress arising in the tube sheet of heat exchangers.

Still another object of the invention is to provide economical heat exchangers free from using heat resisting materials for an inner chamber volume by specifically arranging the inner chamber volume wherein hot fluid flows.

Furthermore the present invention can be applied to heat exchangers other than the U-tube type heat exchangers to minimize the thermal stress arising in the tube sheet.

BRIEF DESCRIPTION OF THE DRAWINGS

FIG. 1 is a section along line B—B in FIG. 1 (*b*), and FIG. 1 (*a''*) and FIG. 1 (*b''*) are temperature distribution curves in respective tube sheets;

FIG. 4 (*b*) is a section along line B—B, and

FIG. 4 (*c*) is a temperature distribution chart of the tube sheet of the heat exchanger in FIG. 2;

DETAILED DESCRIPTION OF THE INVENTION

Now an embodiment of the invention will be described with reference to the accompanying drawings.

Figure 1A:
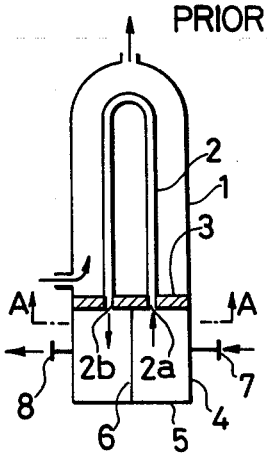
FIG. 1a PRIOR ART
FIGS. 1 (*a*) and (*b*) are schematic vertical sections of conventional U-tube type heat exchangers, FIG. 1 (*a'*) is a section along line A—A in FIG. 1 (*a*), FIG. 1 (*b'*)
Figure 1B:
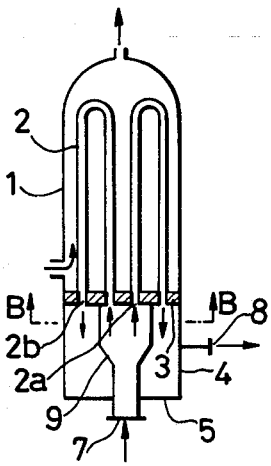
FIG. 1b PRIOR ART
Figure 1B:
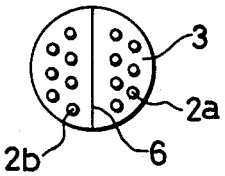
FIG. 1b PRIOR ART
Figure 1B:
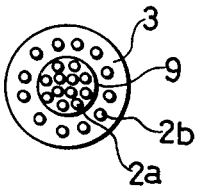
FIG. 1b' PRIOR ART
Figure 1B:
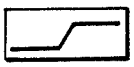
FIG. 1b' PRIOR ART
Figure 1B:
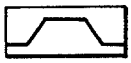
FIG. 1b'' PRIOR ART
Figure 2:
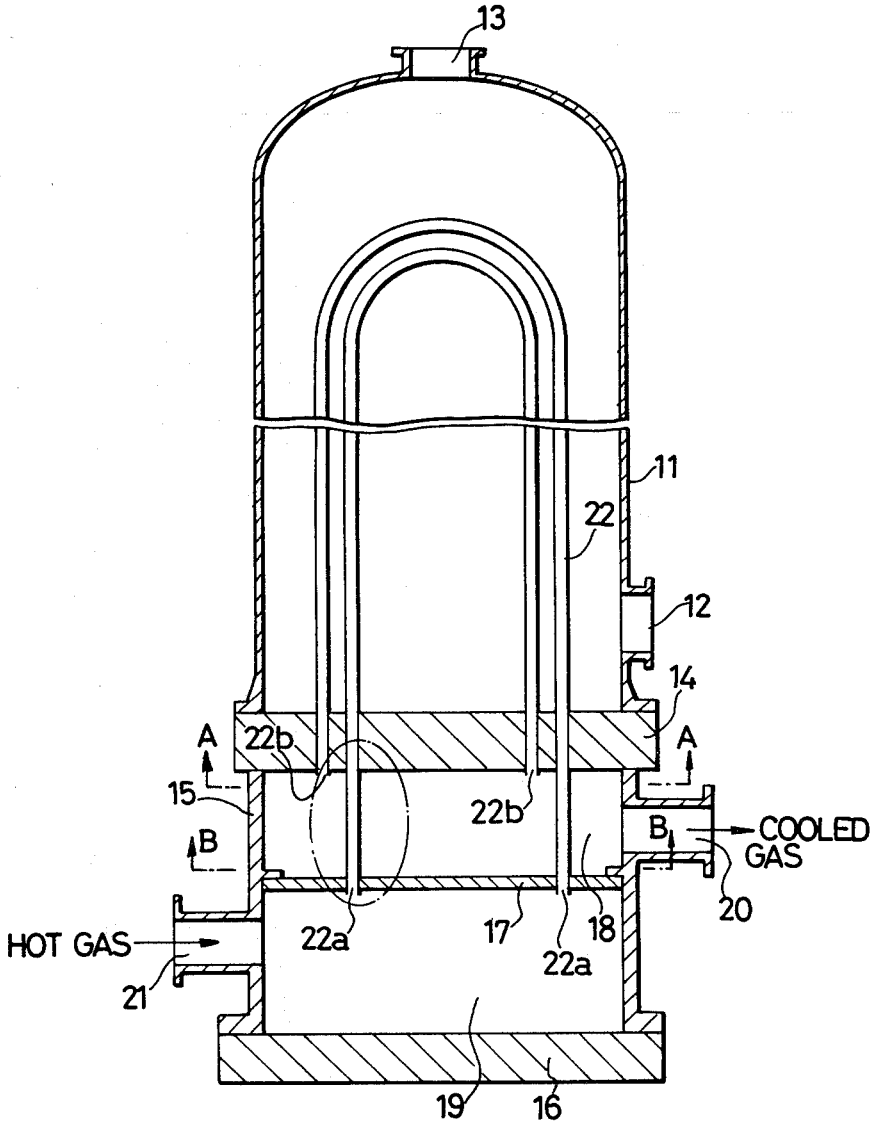
FIG. 2 is a schematic vertical section of a heat exchanger according to the present invention.

FIG. 2 is a schematic section of an embodiment of heat exchangers according to the present invention, wherein a shell 11 has an inlet nozzle 12 and outlet nozzle 13 for a first fluid, a tube sheet 14 being secured to the bottom portion. A stationary head 15 is secured to the side of the tube sheet 14 opposite the shell 11, the lower end of the stationary head 15 being covered by a chamber cover 16 and a separated chamber being defined by the stationary head 15, the chamber cover 16 and the tube sheet 14. The chamber is divided into two volumes 18, 19 by a pass partition 17. The upper volume 18 is provided with an outlet nozzle 20 for a second fluid and the lower volume 19 with an inlet nozzle 21 for the second fluid. A plurality of U-tubes 22 are arranged in the shell 11, one end of each of the U-tubes being open at the lower surface of the pass partition 17 and communicating with the lower volume 19 of the chamber, and the other end of each U-tube, being open at the lower surface of the tube sheet 14 and communicating with the upper volume 18 of the chamber.

Figure 3:
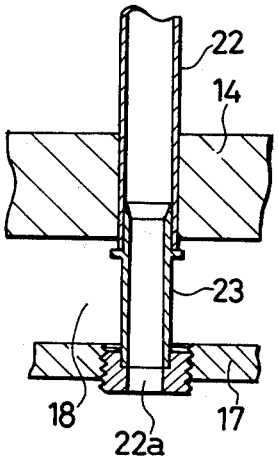
FIG. 3 is a detail schematic section of the region where the tube end is attached to the tube sheet.

FIG. 3 is a schematic section showing how to secure the tube end to the pass partition 17. As shown in the figure, the tube end of the U-tube is secured to the tube sheet 14 and a separate straight tube 23 is connected to the tube end using a tube expansion technique or the like, extended through the upper volume 18 of the chamber and secured to the pass partition 17 with a hollow screw etc.

Figure 4A:
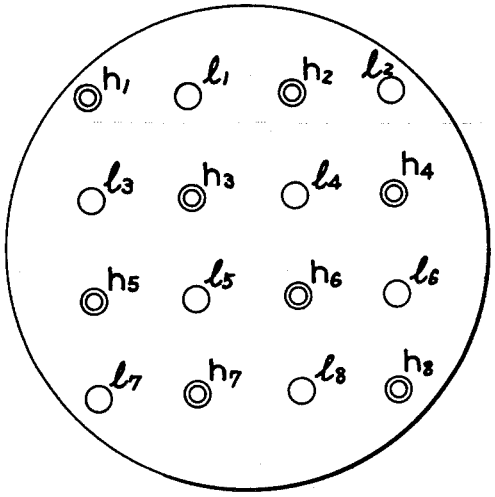
FIG. 4 (*a*) is a section along line A—A in FIG. 2.
Figure 4B:
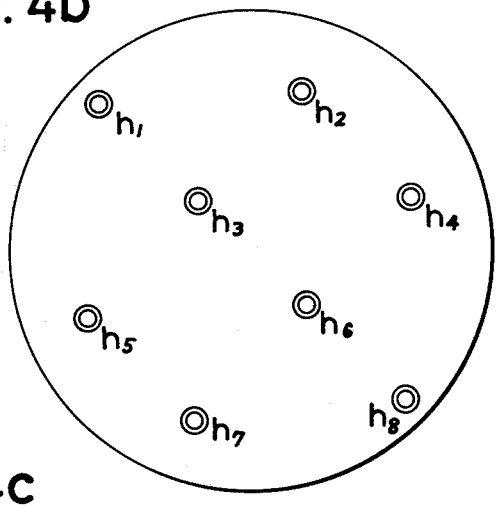
Figure 4C:
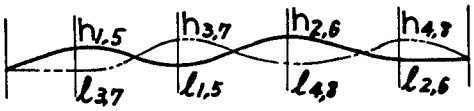

FIGS. 4 (*a*), (*b*) show the sections along lines A—A and B—B in FIG. 2, $h_1$–$h_8$ representing the inlet ends of the tubes 22 for the second fluid and $l_1$–$l_8$ representing the outlet ends of the tubes 22 for the second fluid. Thus, the ends h and l are alternately arranged, the ends $h_1$ and $l_2$ communicate with each other and the ends $l_1$ and $h_2$ communicate with each other, respectively, in the upper part of the shell 11.

In the operation of the above example of the heat exchanger according to the present invention, the first fluid enters from the inlet nozzle 12 into the shell 11 and after exchanging heat with the second fluid and upon being heated, leaves the heat exchanger from the outlet nozzle 13. On the other hand, hot second fluid enters from the inlet nozzle 21, which is in the chamber lower volume 19, into the channel lower room 19, flows through the inlet ports 22*a* of the U-tubes 22, which are open at the pass partition 17, into the U-tubes and after exchanging heat at the U-tube portion 22 with first fluid and being cooled down, goes through the outlet ports 22*b* of the U-tubes, which are open at the tube sheet 14, into the chamber upper volume 18 and leaves the heat exchanger through the outlet nozzle 20.

In this case, the tube sheet 14 comes in contact with cold second fluid which is cooled after exchanging heat with the first fluid, but not directly with hot second fluid. The temperature distribution in the tube sheet 14 is as shown in FIG. 4 (*c*), the portion contacting the inlet ends $h_1$–$h_8$ of the U-tubes 22 being heated and the portion contacting the outlet ends $l_1$–$l_8$ of the U-tubes 22 being cooled, but the temperature difference therebetween is smaller than the conventional ones shown in FIGS. 1 (*a*″) and (*b*″), the curve being relatively flat. Therefore, thermal stress arising in the tube sheet 14 is very small.

Figure 5A:
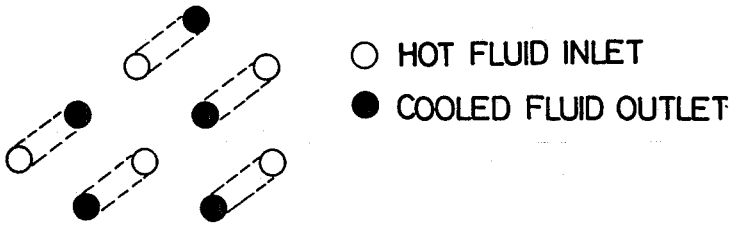
FIGS. 5 (*a*), (*b*) are a schematic views, of tubing of another example of the present invention.
Figure 5B:
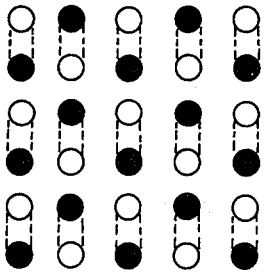

The U-tubes 22 can be arranged in a manner such as shown in FIGS. 5 (*a*) and (*b*), wherein the inlet side portion of each of the tubes is located adjacent to the outlet side portion thereof making the curvature of the curved portion of the U-tubes small.

Figure 6:
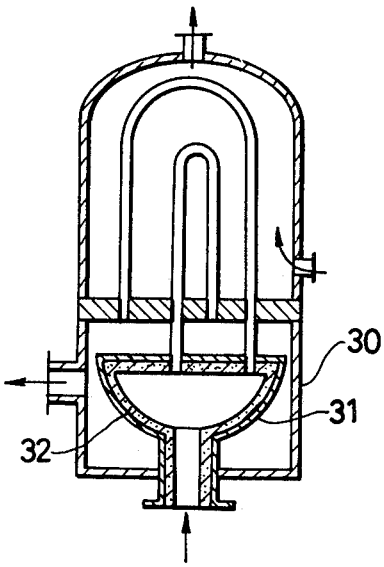
FIG. 6 is a schematic vertical section of still another example of the present invention.

FIG. 6 is a schematic section of another embodiment of a heat exchanger according to the present invention. In this embodiment, an inner chamber volume 31 is provided in the chamber 30 and hot second fluid enters the inner chamber volume 31 and after exchanging heat through the U-tubes and being cooled, flows into the space outside the inner chamber volume 31 and leaves the heat exchanger through the outlet nozzle. The internal surface of the inner chamber volume room 31 is preferably lined with a thermal insulation material. This permits the use of non-heat resisting steel for the wall material of the inner chamber volume 31, since the outside surface of the inner chamber volume 31 does not come in direct contact with the hot second fluid, and the main chamber 30 also is not exposed to the hot second fluid, and therefore, the design of and material selection for heat exchangers can be made on a low temperature basis.

The above embodiments are described using U-tube type heat exchangers, but the construction according to the present invention, wherein a chamber for admitting a hot second fluid is separated to prevent the hot second fluid from directly contacting a thick tube sheet, can be applied to other heat exchangers other than U-tube type heat exchangers, the other heat exchangers being included within the scope of the invention.

What is claimed is:

1. A heat exchanger comprising a shell defining a space which is adapted to contain a first fluid, a tube sheet connected to said shell for closing said space, a plurality of tubes provided in said shell each having an inlet end extending through said shell to admit therein a hot second fluid for exchanging heat with the first fluid, means defining a main chamber connected to said sheet and provided with an outlet port for the second fluid, said main chamber being positioned on the side of said tube sheet opposite said shell, each of said tubes having an outlet end extending through said sheet for the second fluid and opening into said main chamber, said main chamber containing a separate chamber section spaced from said tube sheet, said separate section being provided therein with an inlet port for the hot second fluid and connected to said tube inlet ends which pass through said tube sheet, said tube sheet inlet ends and said tube outlet ends being arranged in rows and columns through said tube sheet with inlet ends alternating with outlet ends of said tubes in said rows and columns to minimize thermal stress in said tube sheet.

2. A heat exchanger according to claim 1, wherein each of said tubes comprises a U-tube having an inlet end and an outlet end, said inlet and outlet ends of each U-tube positioned adjacent each other as said ends pass through said tube sheet whereby the curvature of a curved portion of each U-tube is relatively small.

3. A heat exchanger according to claim 1, wherein said separate chamber section is spaced inwardly of said main chamber.

4. A heat exchanger according to claim 3, wherein said separate chamber section includes a covering of thermal insulation material.

* * * * *